United States Patent [19]

Malashenko

[11] Patent Number: 4,802,954

[45] Date of Patent: Feb. 7, 1989

[54] FORMING BOARD FOR PAPERMAKING MACHINE

[75] Inventor: Alexander Malashenko, Dollard des Ormeaux, Canada

[73] Assignee: Valmet-Dominion Inc., Lachine, Canada

[21] Appl. No.: 203,631

[22] Filed: Jun. 6, 1988

Related U.S. Application Data

[63] Continuation of Ser. No. 932,588, Nov. 20, 1986, abandoned.

[51] Int. Cl.[4] ..... D21F 1/10

[52] U.S. Cl. ..... 162/348; 162/351; 162/352

[58] Field of Search ..... 162/353, 354, 352, 351

[56] References Cited

U.S. PATENT DOCUMENTS

| | | | |
|---|---|---|---|
| 1,579,204 | 4/1926 | Berry | 162/353 X |
| 1,898,372 | 2/1933 | Hyde | 162/353 X |
| 3,052,296 | 9/1962 | Justus | 162/354 |
| 3,352,749 | 11/1967 | Perry | 162/352 |

FOREIGN PATENT DOCUMENTS

| | | |
|---|---|---|
| 670293 | 9/1963 | Canada . |
| 793011 | 8/1968 | Canada . |
| 1074603 | 4/1980 | Canada . |
| 1172484 | 8/1984 | Canada . |

*Primary Examiner*—Peter Chin
*Assistant Examiner*—Thi Dang
*Attorney, Agent, or Firm*—Raymond A. Eckersley

[57] ABSTRACT

A papermaking machine having a forming wire, a headbox and a forming board is disclosed. The headbox includes a lower slice having an apron positioned substantially in alignment with and closely adjacent the forming board such that as the forming wire travels over the the forming board the jet of paper stock leaving the headbox is laid onto the wire at the board at substantially zero angle of impingement. The forming board further includes a lead-in blade over which the wire travels. The blade acts to deflect fluid, normally pumped by the wire along its path of travel, away from the underside to the jet of paper stock prior to this jet reaching the forming board. Advantage is found with the disclosed papermaking machine in that it substantially eliminates pumping of fluid to the underside of the stock, has zero angle of impingement of the stock onto the wire and prevents drainage at the point of impingement which reduces the loss of fine fibres through the wire and minimizes the disturbance of the paper stock resulting in better paper formation and increased operating speeds.

10 Claims, 3 Drawing Sheets

FORMING BOARD FOR PAPERMAKING MACHINE

This application is a continuation of application Ser. No. 932,588, filed 11/20/86, now abandoned.

FIELD OF THE INVENTION

The present invention relates to a papermaking machine of the Fourdrinier type. In particular, it relates to the headbox lower slice lip and the forming board.

BACKGROUND OF THE INVENTION

Fourdrinier papermaking machines currently in use employ a headbox having upper and lower slices that control the jet of stock leaving the headbox. The stock passes over an apron of the lower slice and impinges a forming wire. The forming wire carries the stock through various nips in the forming section so as to dewater the stock and thereby form the paper from the stock. The forming wire in the vicinity of the headbox passes around a breast roll located beneath the headbox and over a forming board. The forming board is positioned in spaced apart relation offset from the apron of the lower slice lip so that after the stock leaves the apron its projectory is such that the jet impinges the wire at a predetermined angle of impingement. In current papermaking machines this angle of impingement is about 5 degrees. The forming wire is known to provide windage as it travels about the breast roll and is known to have fluids entrained in the wire. A fluid shower of water and air passes beneath the underside to the lower slice of the headbox ensuring that there is no build up of paper fibre from the returning wire which could be introduced to the underside of the jet of stock.

There are basically two disadvantages associated with the above described papermaking machine. First the angle of impingement that the stock meets the forming wire tends to produce instabilities and back flow which creates disturbances in the fibres of the stock and results in drainage at the point of impingement causing loss of fine fibres through the wire. Secondly, the pumping action of the wire tends to follow the path of travel of the wire introducing a fluid shower to the underside of the stock which crates further disturbances to the fibres in the underside of the stock.

With respect to the pumping action of the wire, this problem has been recognized previously in Canadian Pat. No. 670,293 which issued Sept. 10, 1963 to Joseph Baxter, Jr. The primary object of this patent is to overcome the difficulties associated with windage from the wire tending to disrupt uniform deposit of stock on the wire. Baxter teaches eliminating the windage problem by introducing a steam chamber between the lower slice lip and the breast roll. The steam chamber produces steam that strips the wire of all windage as the wire passes through the chamber. Baxter further teaches that the condensing of the steam will necessarily produce a corresponding increase in the temperature of the stock resulting in the steam being absorbed. Applicant is not aware of such a steam chamber being used in Fourdrinier type paper machines. The problem with this solution is that the steam under pressure hits the underside of the paper stock destabilizing the stock. Further, the heat generated by the steam chamber heats up the underside of the headbox introducing uncontrollable creep to the lower slice which disturbs the stock jet. Also, the headbox is designed to maintain the temperature of the stock within a predetermined range which will be effected by the heating of the lower slice.

SUMMARY OF THE PRESENT INVENTION

It is therefore an object of the present invention to provide a papermaking machine that substantially eliminates the introduction of fluids to the underside of the paper stock as it is deposited onto the forming wire.

It is a further object of the present invention to minimize disturbances and drainage which occur as the paper stock is deposited on the forming wire.

In accordance with one aspect of the present invention there is provided a papermaking machine comprises a forming wire, and a headbox for producing a jet of paper stock. The headbox includes a lower slice having an apron. The paper machine further includes a forming board having a rear section spaced rearwardly of the apron in the direction of paper stock travel to define a gap therewith through which the forming wire passes a the wire travels over the forming board. The rear section is positioned substantially in alignment with the apron so that the jet of paper stock leaving the headbox is laid onto the forming wire at the rear section of the forming board at substantially zero degrees angle of impingement to thereby minimize disturbance of the paper stock and minimize drainage as the stock leaves the headbox and impinges the wire. Clearly, advantage is found by the forming board and apron being positioned in alignment to provide an angle of impingement of substantially zero degrees since this lays the stock onto the wire with minimal disturbance substantially eliminating drainage. In effect, the headbox and the forming board of the paper machine appear to the stock as being almost continuous.

In accordance with another aspect of the present invention there is provided a papermaking machine comprising a forming wire and a headbox for producing a jet of paper stock. The headbox includes a lower slice having an apron. The machine further includes a forming board having a rear section, a lead-in blade and a front wall. The rear section is spaced rearwardly of the apron in the direction of paper travel to define a gap therewith through which the forming wire passes as the wire travels over the forming board to receive the jet of paper stock. The lead-in blade is positioned above the front wall portion forwardly and downwardly from the forming section. The front wall extends rearwardly and downwardly from the lead-in blade. The lead-in blade deflects fluid pumped by the forming wire through the forming wire and along the front wall reducing the amount of fluid pumped toward the underside of the jet of paper stock and thereby reducing the disturbing effect this fluid has on the underside of the jet. As a result, any disturbances effecting the underside of the jet of paper stock as it impinges the forming wire are minimized.

To enhance fluid reduction to the underside of the jet of paper stock it is envisaged that the paper machine further includes an exhaust located rearwardly of the lead-in blade below the gap and adjacent the forming section to draw away any fluid remaining with the forming wire through the forming wire before the forming wire reaches the underside of the jet of paper stock. Alternately, the paper machine may further include an exhaust located in the front wall to enhance the amount of fluid deflected along the front wall.

It is also envisaged that the apron may have a tip projecting downwardly from its undersurface toward the forming wire adjacent the gap. This tip may contact the forming wire.

In one embodiment of the present invention the lead-in blade projects beneath the lower slice of the headbox. In another embodiment of the present invention the lead-in blade is spaced rearwardly of the apron.

BRIEF DESCRIPTION OF THE DRAWINGS

For a better understanding of the nature and objects of the present invention, reference may be had to the accompanying diagrammatic drawings in which.

DESCRIPTION OF THE PREFERRED EMBODIMENTS

Figure 1:
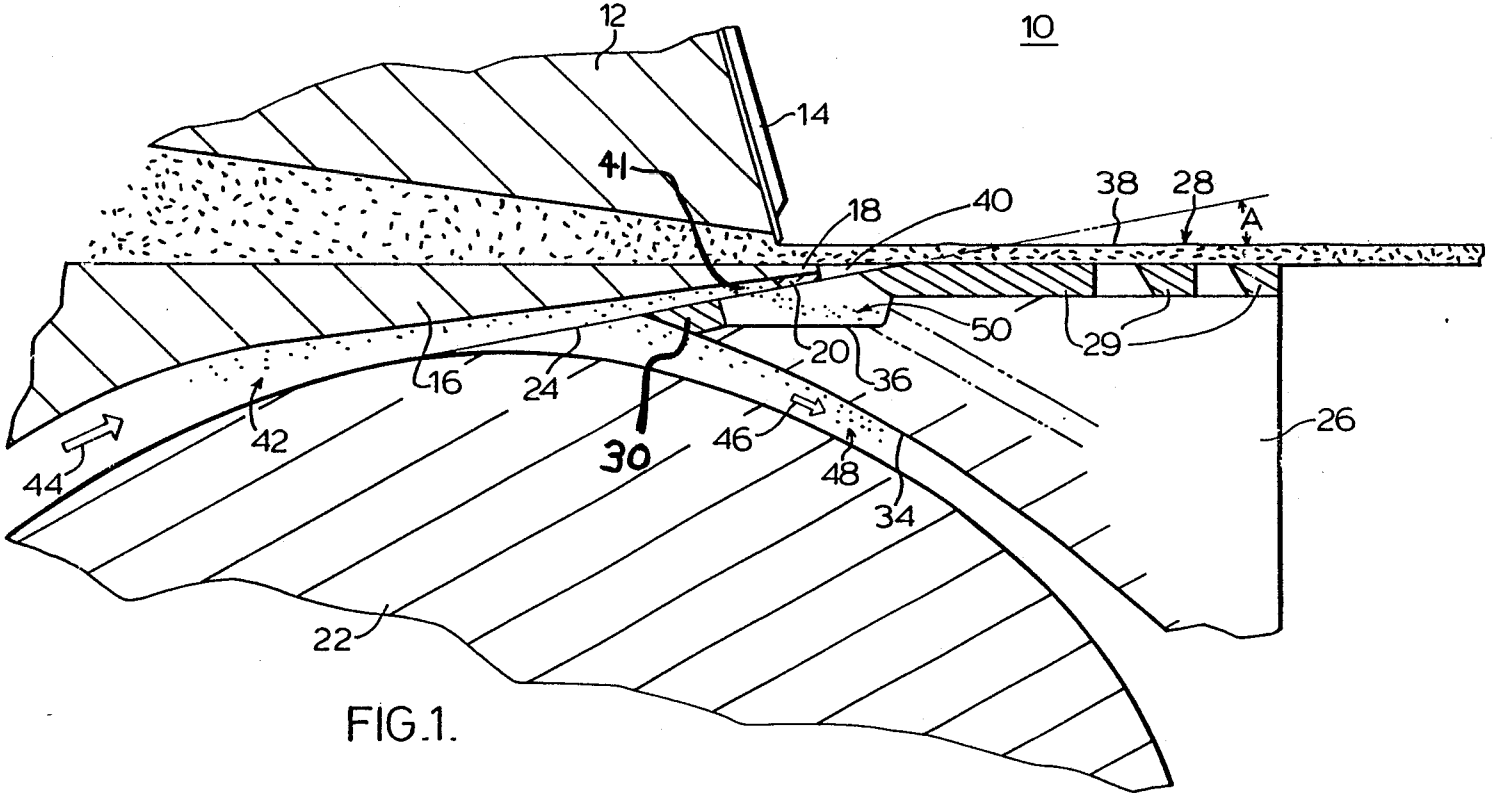
FIGS. 1 to 4 are schematic views of four preferred embodiments of the papermaking machine of the present invention.

Referring to FIG. 1 there is shown a portion of a papermaking machine generally at 10. The papermaking machine 10 includes a headbox 12 having an upper slice 14 and a lower slice 16. The lower slice 16 includes an apron 18. The apron 18 has a tip 20 that projects downwardly from its underside.

The papermaking machine further includes a breast roll 22 about which a forming wire 24 travels. The last section of the papermaking machine illustrated in this figure is the forming board 26. The forming board 26 includes a rear section 28 including foil 29 positioned in alignment with and spaced from the apron 18. The forming board 26 has a lead-in blade shown generally at 30 as a foil. In this embodiment, the lead-in blade 30 projects beneath the lower slice 16 of the headbox 12 so that the lower slice 16 overlaps the lead-in blade 30 and defines a passage 41 therebetween through which the forming wire 24 passes. As shown in the Figure, the wire 24 passes over the lead-in blade 30 and the front tip of foil 29 at an angle A which is about ten degrees and can lie in the range of 5 to 15 degrees. The lead-in blade is positioned above a front wall portion 34 of forming board 26 with the top end of wall 34 sloping downwardly from and co-extensively with the lead-in blade. An exhaust is shown at 36 behind the lead-in blade 30 in the direction of wire travel. The exhaust may comprise a fan applying suction to the wire 24 as it passes over exhaust 36.

In operation, headbox 12 delivers a jet of paper stock 38 between its upper and lower slices 14 and 16. As the stock leaves the slices, it passes over apron 18, across gap 40 and impinges on the forming wire 24 at the rear section 28 of the forming board 26. It should be understood that the distance across gap 40 between the edge of apron 18 and the forming board 26 is relatively small and in the preferred embodiment is about 3 inches. Because the apron 18 and the rear section 28 of the forming board are in alignment, the angle of impingement is zero degrees. As a result, the stock is delivered from the headbox to the forming board with minimal disturbance and no drainage at the point of impingement.

The forming wire travels around breast roll 22 pumping fluid shown generally at 42 in the direction of arrow 44. The tip of the lead-in blade 30 deflects much of the fluid through the wire and along front wall 34. This is shown by arrow 46 and fluid 48. Any fluid continuing to travel with the wire 24 is deflected by tip 20 on the underside of the apron and is drawn into the exhaust 36. This is shown as fluid 50. It should be understood that the back pressure created by exhaust 36 should be sufficient to draw the fluid into the exhaust without disturbing the underside of the jet of paper stock 38. By deflecting the fluid away from the underside of the paper stock the present invention eliminates disturbances caused to the underside of the paper stock by the fluid pumping action of the wire.

Figure 2:
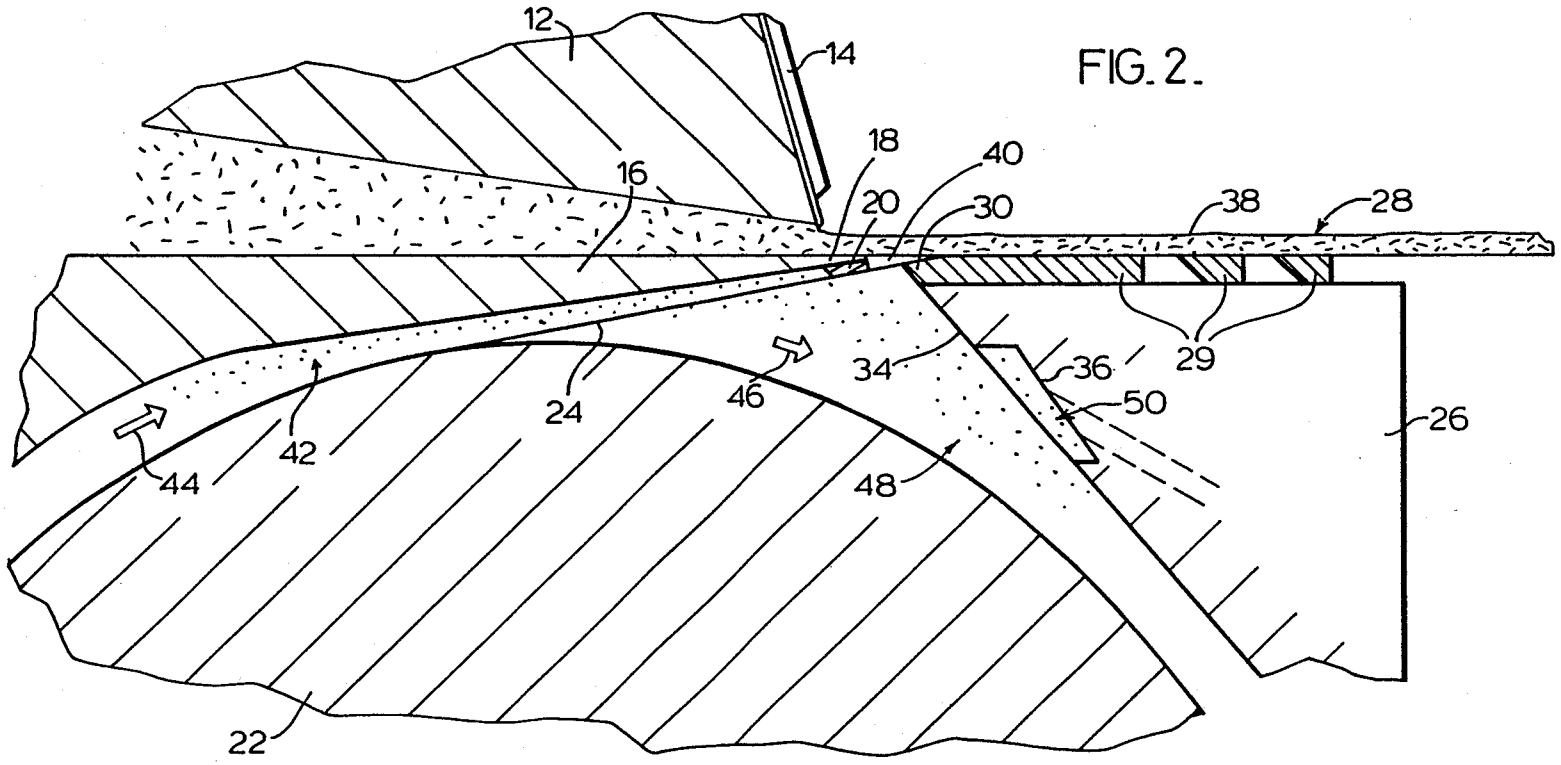

Referring to FIG. 2 there is shown another preferred embodiment of the present invention wherein the lead-in blade 30 does not project beneath the lower slice 16 of the headbox 12 but is instead positioned rearwardly of the apron 18 in the direction of wire travel. In this embodiment the exhaust 36 is located in the front wall 34 to enchance fluid deflection through the wire 24 and along front wall 34.

Figure 3:
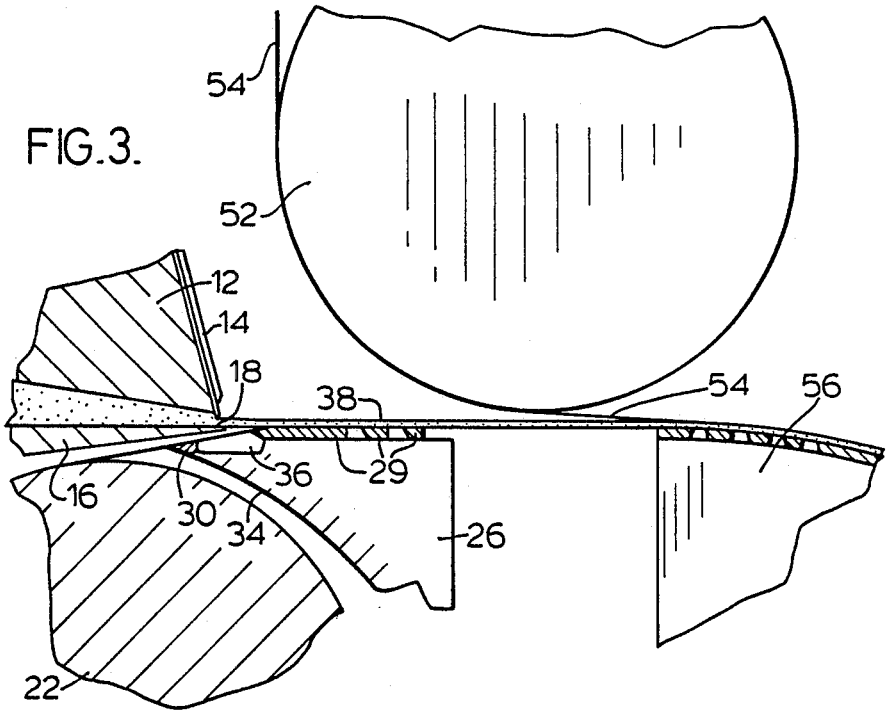

FIG. 3 is directed to the same embodiment as FIG. 1; however the apron 18 in this embodiment does not include the depending tip 20. This embodiment shows a further breast roll 52 around which a second forming wire 54 travels. The second forming wire 54 meets the stock is provided adjacent forming section 56.

Figure 4:
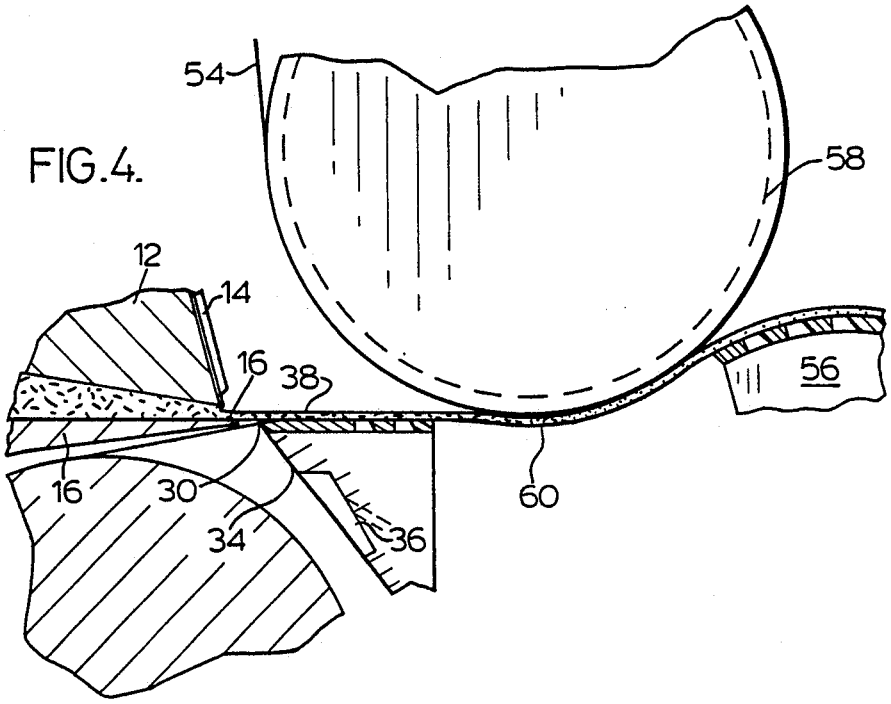

FIG. 4 is directed to the same embodiment as FIG. 2; however the apron 18 in this embodiment does not include the depending tip 20. This embodiment shows a forming roll 58. A nip 60 is provided between the roll 58 and wires 24 and 54 just prior to the forming section 56.

What I claim as new and desire to secure by Letters Patent of the United States is:

1. A papermaking machine comprising:

a forming wire;

a headbox for producing a jet of paper stock, the headbox including a lower slice lip having an apron; and, a forming board having a rear section spaced rearwardly of the apron in the direction of paper stock travel to provide a gap between the apron and rear section, the rear section being positioned substantially in alignment with the apron, the forming board including a lead-in blade angled with respect to the rear section and projecting downwardly below the substantial alignment of the rear section and the apron, the forming wire passing over the lead-in blade and changing direction of travel as the wire passes through the gap to a direction of travel in alignment with the apron as the forming wire travels over the rear section such that the jet of paper stock leaving the headbox passes across the gap and is laid onto the forming wire travelling over the rear section of the forming board at substantially zero degrees angle of impingement to thereby minimize disturbance of the paper stock and minimize drainage as the stock leaves the headbox and impinges the wire.

2. A papermaking machine comprising:

a forming wire;

a headbox for producing a jet of paper stock, the headbox including a lower slice lip having an apron; and, a forming board having a rear section, a lead-in blade and a front wall, the rear section being positioned beside the apron and spaced rearwardly of the apron in the direction of paper stock travel to provide a gap between the apron and rear section;

the lead-in blade being positioned beneath the lower slice lip with the lower slice lip overlapping the lead-in blade, and the lead-in blade projecting forwardly and downwardly from the rear section in the direction of wire travel to define a passage between the lower slice and the lead-in blade where the lower slice overlaps the lead-in blade, the forming wire passing over the lead-in blade, along the passage, through the gap and over the rear section of the forming board to receive the jet of paper stock, the front wall extending below the forming wire rearwardly and downwardly away from the lead-in blade, the lead-in blade deflecting fluid, pumped by the forming wire, away from the passage and the gap through the forming wire and along the front wall prior to the forming wire reaching the passage so as to reduce the amount of fluid pumped by the wire along the passage through the gap toward the underside of the jet of paper stock and thereby reducing the disturbing effect on the underside of thpg,18 caused by fluid passing along the passage through the gap.

3. The papermaking machine of claim 2 further including an exhaust located rearwardly of the lead-in blade in the direction of wire travel, said exhaust being positioned adjacent the passage and the gap to draw away any remaining fluid left in the forming wire prior to the forming wire passing through the gap and reaching the underside of the jet of paper stock.

4. The papermaking machine of claim 2 further including an exhaust located in the front wall below the lead-in blade and the forming wire to enhance the amount of fluid deflected by the lead-in blade through the forming wire and along the front wall.

5. The papermaking machine of claim 2 further including a breast roll around which the forming wire travels, the breast roll being positioned below the headbox, the lead-in blade and the front wall.

6. The papermaking machine of claim 2 wherein the apron has an undersurface having a tip projecting downwardly into the passage toward the forming wire in advance of the gap in the direction of wire travel.

7. The papermaking machine of claim 6 wherein the tip contacts the forming wire.

8. A papermaking machine comprising:

a forming wire;

a headbox for producing a jet of paper stock, the headbox including a lower slice lip having an apron; and, a forming board having a rear section, a lead-in blade and a front wall;

the rear section being spaced rearwardly of the apron in the direction of paper stock travel to provide a gap between the apron and rear section, the forming wire passing through the gap and over the rear section of the forming board to receive the jet of paper stock; and, the lead-in blade being spaced rearwardly of the apron and projecting forwardly and downwardly from the rear section in the direction of wire travel and, the front wall extending below the forming wire rearwardly and downwardly away from the lead-in blade, the lead-in blade deflecting fluid, pumped by the forming wire, away from the gap through the forming wire and along the front wall prior to the forming wire reaching the gap, an exhaust being located in the front wall below the lead-in blade and the forming wire to enhance the amount of fluid deflected by the lead-in blade through the forming wire and along the front wall and to reduce the amount of fluid pumped by the forming wire through the gap toward the underside of the jet of paper stock and thereby reducing the disturbing effect on the underside of the jet caused by fluid passing through the gap.

9. The papermaking machine of claim 8 wherein the apron has an undersurface having a tip projecting downwardly toward the forming wire in advance of the gap in the direction of wire travel.

10. The papermaking machine of claim 9 wherein the tip contacts the forming wire.

* * * * *